US005781834A

United States Patent [19]

Teschendorf et al.

[11] Patent Number: 5,781,834

[45] Date of Patent: *Jul. 14, 1998

[54] APPARATUS AND METHOD FOR REMOVING DEVELOPER LIQUID FROM AN IMAGING SUBSTRATE

[75] Inventors: Brian P. Teschendorf; W. Blake Kolb, both of St. Paul; Thomas M. Milbourn, Mahtomedi, all of Minn.

[73] Assignee: Minnesota Mining and Manufacturing Company, St. Paul, Minn.

[ * ] Notice: The term of this patent shall not extend beyond the expiration date of Pat. No. 5,576,815.

[21] Appl. No.: 918,490

[22] Filed: Aug. 26, 1997

Related U.S. Application Data

[63] Continuation of Ser. No. 876,828, Jun. 16, 1997.

[51] Int. Cl.[6] ..... G03G 15/10

[52] U.S. Cl. ..... 399/249; 15/256.51; 492/18; 492/56

[58] Field of Search ..... 399/237, 249; 15/256.51, 256.52; 492/18, 56

[56] References Cited

U.S. PATENT DOCUMENTS

| | | | |
|---|---|---|---|
| 4,482,242 | 11/1984 | Moraw et al. | 399/249 |
| 4,990,962 | 2/1991 | Kishi | 399/249 X |
| 5,420,675 | 5/1995 | Thompson et al. | 399/237 |
| 5,432,591 | 7/1995 | Geleynse | 399/249 |
| 5,463,453 | 10/1995 | Kurotori et al. | 399/249 |

*Primary Examiner*—S. Lee
*Attorney, Agent, or Firm*—William D. Bauer

[57] ABSTRACT

An imaging system and method incorporate an apparatus and method for cleaning developer liquid from an imaging substrate such as a photoreceptor. The system and method operate to move the imaging substrate in a first direction, form a latent electrostatic image on an imaging region of the imaging substrate, engage a development device in proximity with the imaging substrate, load a squeegee roller against the imaging substrate, the squeegee roller being driven by the imaging substrate in the first direction, apply developer liquid from the development device to the imaging region, thereby developing the latent electrostatic image, terminate application of developer liquid from the development device upon movement of a nonimaging region of the imaging substrate past the development device, wherein the disengagement of the development device leaves on the imaging substrate a second excess volume of the developer liquid, drive the squeegee roller in a second direction upon movement of the nonimaging region past the squeegee roller, the squeegee roller substantially removing the second excess volume of developer liquid, and transfer the developer liquid remaining on the imaging region to an imaging substrate, thereby forming a representation of an image.

16 Claims, 3 Drawing Sheets

APPARATUS AND METHOD FOR REMOVING DEVELOPER LIQUID FROM AN IMAGING SUBSTRATE

This is a division of application Ser. No. 08/876,828 filed Jun. 16, 1997.

FIELD OF THE INVENTION

The present invention relates generally to liquid electrographic imaging technology and, more particularly, to techniques for cleaning developer liquid from an imaging substrate in a liquid electrographic imaging system.

DISCUSSION OF RELATED ART

A liquid electrographic imaging system includes an imaging substrate onto which a developer liquid is delivered to develop a latent image. A liquid electrographic imaging system may comprise as the imaging substrate a dielectric or a photoreceptor. A photoreceptor includes a photoconductive material. A latent image can be formed on a photoreceptor by selectively discharging the photoreceptor with a pattern of radiation, whereas a latent image can be formed on a dielectric by selectively discharging the dielectric with an electrostatic stylus. A liquid electrophotographic imaging system will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrographic imaging system.

The erasure station exposes the photoreceptor to erase radiation sufficient to uniformly discharge any electrostatic charge remaining from a previous imaging operation. The charging station electrostatically charges the photoreceptor. The exposure station selectively discharges the photoreceptor to form a latent electrostatic image.

A multi-color imaging system may include several exposure stations that form a plurality of latent images. Each of the latent images in a multi-color imaging system is representative of one of a plurality of color separation images for an original multi-color image to be reproduced. As a latent image is formed, the development station applies developer liquid to the photoreceptor to develop the latent image. In a multi-color imaging system, each of a plurality of development stations applies an appropriately colored developer liquid to the photoreceptor to form an intermediate representation of the corresponding color separation image. The drying station dries the developer liquid applied by the development station or stations. The transfer station then transfers the developer liquid applied by the development stations from the photoreceptor to an output substrate, such as a sheet of paper or film, to form a visible representation of the original image.

A development station typically includes a development device, such as a development roller or belt, and a squeegee roller. Use of a development roller will be discussed for purposes of example. A development roller is rotated by a drive mechanism, whereas the squeegee roller typically is passively driven by the photoreceptor. The biased, rotating development roller applies developer liquid to the surface of an imaging region of the photoreceptor to develop the latent image. The squeegee roller removes from the photoreceptor excess developer liquid applied by the development roller.

The development roller is engaged in proximity with the surface of the photoreceptor for developer liquid delivery. In other words, the development roller typically is positioned a short distance from the surface of the photoreceptor, enabling a thin layer of developer liquid to be delivered across the resulting gap. The bias is applied to the development roller to develop the latent image with the developer liquid delivered by the development roller. In a multi-color imaging system, the development process is repeated with each of a plurality of development stations applying differently colored developer liquids to the photoreceptor to develop different color separation images.

The development roller and squeegee roller can leave excess developer liquid on the photoreceptor. A first excess volume of developer liquid is produced during delivery of developer liquid by the development roller for development of the latent image. Specifically, the development roller applies an amount of developer liquid that exceeds the amount necessary to develop the latent image. The passively driven squeegee roller typically serves to remove this first excess volume of developer liquid from the photoreceptor. A second excess volume of developer liquid is produced when delivery of developer liquid by the development roller is stopped. Delivery of developer liquid by the development roller can be stopped, for example, by disengaging the development roller from proximity with the photoreceptor, stopping the delivery of developer liquid to the development roller, or obstructing application of developer liquid from the development roller to the photoreceptor. In each case, a portion of the excess developer liquid remaining in the gap between the photoreceptor and the development roller tends to remain on the photoreceptor, producing a second excess volume of developer liquid on the photoreceptor. If the squeegee roller is also disengaged, a portion of the first excess volume of developer liquid also may remain on the photoreceptor. The excess volume of developer liquid remaining on the photoreceptor is sometimes referred to as a "drip line."

If the excess developer liquid is not removed from the photoreceptor, several problems can occur in the imaging process. First, in a multi-color imaging system, the excess developer liquid can cause cross contamination of differently colored developer liquids delivered by the various development stations. The cross contamination can degrade the quality of subsequent images over a period of time. Second, excessive developer liquid on the photoreceptor can contaminate the image being formed, causing incomplete image transfer from the photoreceptor and image staining. Third, internal components of the imaging system can become contaminated with developer liquid, possibly requiring a vigorous cleaning of the entire system. Fourth, any developer liquid that is not returned directly to the fluid return system of the development station is wasted. This wasted amount of developer liquid results in excessive consumption of developer liquid and decreases the number of images that can be formed for a given volume of developer liquid.

In view of the problems that can result from formation of excess developer liquid on an imaging substrate such as a photoreceptor in a liquid electrographic imaging system, there is a need for a technique for effectively removing the excess developer liquid.

SUMMARY OF THE INVENTION

The present invention is directed to an apparatus and method for removing developer liquid from an imaging substrate in a liquid electrographic imaging system, and to a liquid electrographic imaging system and method incorporating an apparatus and method for removing developer liquid from a photoreceptor.

In a first embodiment, the present invention provides a method for removing developer liquid from a photoreceptor, the method comprising the steps of moving the photoreceptor in a first direction, loading a squeegee roller against the photoreceptor, the squeegee roller being driven by the photoreceptor in the first direction, wherein the squeegee roller removes from an imaging region of the photoreceptor a first excess volume of developer liquid applied by a development device during development of a latent electrostatic image in the imaging region of the photoreceptor, and driving the squeegee roller in a second direction opposite to the first direction upon movement of a nonimaging region of the photoreceptor past the squeegee roller, the squeegee roller substantially removing from the photoreceptor a second excess volume of developer liquid formed by termination of application of developer liquid to the photoreceptor by the development device.

In a second embodiment, the present invention provides an apparatus for removing excess developer liquid from a photoreceptor, the apparatus comprising means for moving the photoreceptor in a first direction, a squeegee roller, means for loading the squeegee roller against the photoreceptor, the squeegee roller being driven by the photoreceptor in the first direction, wherein the squeegee roller removes from an imaging region of the photoreceptor a first excess volume of developer liquid applied by a development device during development of a latent electrostatic image in the imaging region of the photoreceptors and means for driving the squeegee roller in a second direction opposite to the first direction upon movement of a nonimaging region of the photoreceptor past the squeegee roller, the squeegee roller substantially removing from the photoreceptor a second excess volume of developer liquid formed by termination of application of developer liquid to the photoreceptor by the development device.

In a third embodiment, the present invention provides an imaging method comprising the steps of moving an imaging substrate in a first direction, forming a latent electrostatic image on an imaging region of the imaging substrate, engaging a development device in proximity with the imaging substrate, loading a squeegee roller against the imaging substrate, the squeegee roller being driven by the imaging substrate in the first direction, applying developer liquid from the development device to the imaging region of the imaging substrate, thereby developing the latent electrostatic image, wherein the squeegee roller removes from the imaging region of the imaging substrate a first excess volume of the developer liquid, terminating application of the developer liquid from the development device to the imaging substrate upon movement of a nonimaging region of the imaging substrate past the development device, wherein the termination of application of the developer liquid from the development device leaves on the imaging substrate a second excess volume of the developer liquid, driving the squeegee roller in a second direction opposite to the first direction upon movement of the nonimaging region of the imaging substrate past the squeegee roller, the squeegee roller substantially removing from the imaging substrate the second excess volume of developer liquid, and transferring the developer liquid remaining on the imaging region of the imaging substrate to an output substrate, thereby forming a visible representation of an image.

In a fourth embodiment, the present invention provides an imaging system comprising an imaging substrate, means for moving the imaging substrate in a first direction, means for forming a latent electrostatic image on an imaging region of the imaging substrate, a development device, means for engaging the development device in proximity with the imaging substrate, a squeegee roller, means for loading the squeegee roller against the imaging substrate, the squeegee roller being driven by the imaging substrate in the first direction, wherein the development device applies developer liquid to the imaging region of the imaging substrate, thereby developing the latent electrostatic image, and wherein the squeegee roller removes from the imaging region of the imaging substrate a first excess volume of the developer liquid, means for terminating application of developer liquid by the development device upon movement of a nonimaging region of the imaging substrate past the development device, wherein the termination of application of the developer liquid by the development device leaves on the imaging substrate a second excess volume of the developer liquid, means for driving the squeegee roller in a second direction opposite to the first direction upon movement of the nonimaging region of the imaging substrate past the squeegee roller, the squeegee roller substantially removing from the imaging substrate the second excess volume of the developer liquid, and means for transferring the developer liquid remaining on the imaging region of the imaging substrate to an output substrate, thereby forming a visible representation of an image.

In a fifth embodiment, the present invention provides a method for removing developer liquid from an imaging substrate, the method comprising the steps of moving the imaging substrate in a first direction, loading a first squeegee roller against the imaging substrate, the first squeegee roller being driven by the imaging substrate in the first direction, wherein the first squeegee roller removes from an imaging region of the imaging substrate a first excess volume of developer liquid applied by a development device during development of a latent electrostatic image in the imaging region of the imaging substrate, loading a second squeegee roller against the imaging substrate, and driving the second squeegee roller in a second direction opposite to the first direction upon movement of a nonimaging region of the imaging substrate past the second squeegee roller, the second squeegee roller substantially removing from the imaging substrate a second excess volume of developer liquid formed by termination of application of developer liquid to the imaging substrate by the development device.

The advantages of the apparatus and method of the present invention will be set forth in part in the description that follows, and in part will be apparent from the description, or may be learned by practice of the present invention. The advantages of the apparatus and method of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
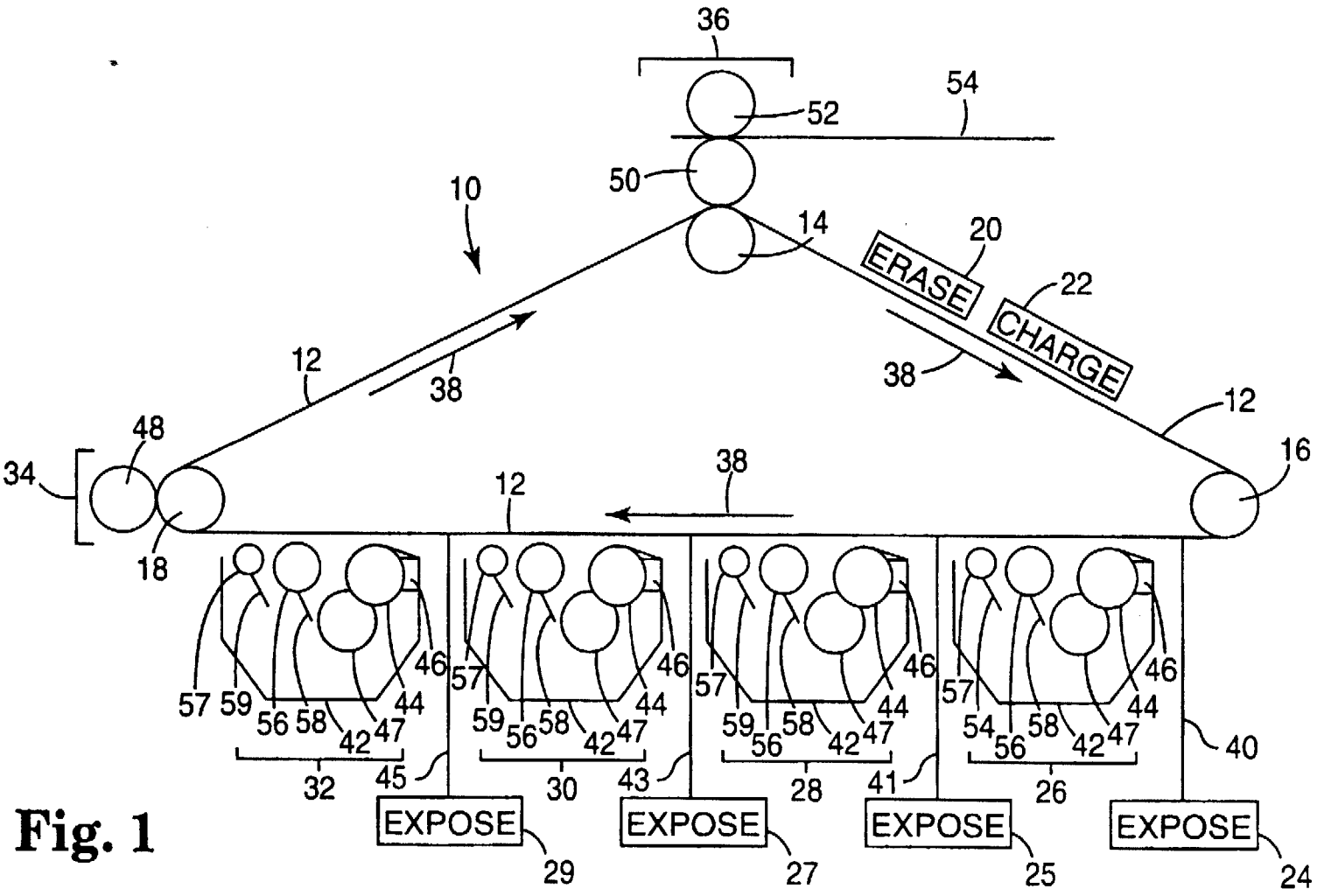
FIG. 1 is a schematic diagram of an exemplary liquid electrographic imaging system incorporating an apparatus for removing developer liquid from an imaging substrate, in accordance with the present invention.

FIG. 1 is a schematic diagram of an exemplary liquid electrographic imaging system 10 incorporating an apparatus and method for removing developer liquid from an imaging substrate, in accordance with the present invention. The liquid electrographic system 10 of FIG. 1 is a liquid electrophotographic system 10 incorporating as the imaging substrate a photoreceptor 12. The system 10 of FIG. 1 is configured to form a multi-color image in a single pass of photoreceptor 12. The single-pass system 10 enables multi-color images to be assembled at extremely high speeds. An example of a liquid electrophotographic imaging system configured to assemble a multi-color image in a single pass of a photoreceptor is disclosed in copending and commonly assigned U.S. patent application Ser. No. 08/537,296 filed Sep. 29, 1995, entitled "METHOD AND APPARATUS FOR PRODUCING A MULTI-COLORED IMAGE IN AN ELECTROPHOTOGRAPHIC SYSTEM". The entire content of the above-referenced patent application is incorporated herein by reference.

Although imaging system 10 is shown as a multi-color, single-pass system in FIG. 1, the apparatus and method of the present invention can be readily applied to remove developer liquid from photoreceptors in both single-color liquid electrographic imaging systems and multi-color, multi-pass liquid electrographic imaging systems. In addition, the apparatus and method of the present invention can be readily applied to remove developer liquid in systems in which the photoreceptor is configured as a photoreceptor belt, a photoreceptor drum, or a photoreceptor sheet. The apparatus and method of the present invention similarly could be applied to single pass or multi-pass electrographic systems incorporating dielectric belts, drums, or sheets. Therefore, incorporation of the apparatus and method of the present invention in the particular multi-color, single-pass imaging system 10 of FIG. 1 should be considered exemplary only.

As shown in FIG. 1, imaging system 10 includes photoreceptor 12 in the form of a continuous photoreceptor belt mounted about first, second, and third belt rollers 14, 16, 18, an erasure station 20, a charging station 22, a plurality of exposure stations 24, 25, 27, 29, a plurality of development stations 26, 28, 30, 32, a drying station 34, and a transfer station 36. In operation of system 10, photoreceptor 12 is moved to travel in a first direction indicated by arrows 38. The photoreceptor 12 can be moved, for example, by activating a motor coupled to a rotor shaft associated with one of belt rollers 14, 16, 18. As photoreceptor 12 moves in first direction 38, erasure station 20 exposes the photoreceptor to erase radiation to uniformly discharge any electrostatic charge remaining from a previous imaging operation. The charging station 22 then charges the surface of photoreceptor 12 to a predetermined level.

The exposure station 24 emits a beam 40 of radiation that selectively discharges an imaging region of the charged photoreceptor 12 in an imagewise pattern to form a latent electrostatic image. The exposure station 24 may comprise, for example, a scanning laser module. For multi-color imaging, each of exposure stations 24, 25, 27, 29 forms a latent image representative of one of a plurality of color separation images of an original image to be reproduced. In an electrographic imaging system using a dielectric imaging substrate, the means for forming the latent images may comprise, for example, an electrostatic stylus. The combination of the color separation images produces an overall multi-color representation of the original image. The exposure stations 24, 25, 27, 29 emit radiation beams 40, 41, 43, 45, respectively, to form latent images in the same imaging region of photoreceptor 12. Thus, each of exposure stations 24, 25, 27, 29 forms a latent image on photoreceptor 12 as the imaging region passes the respective exposure station.

As further shown in FIG. 1, each of development stations 26, 28, 30, 32 includes a developer liquid recovery reservoir 42, a cylindrical development roller 44, and a developer liquid delivery plenum 46. As an alternative each of development stations 26, 28, 30, 32 may include a development belt or other development device. An example of a suitable develpoment station is disclosed in U.S. Pat. No. 5,576,815, Teschendorf et al, the entire content of which is incorporated herein by reference.

With reference to FIG. 1, development roller 44 is in fluid communication, via plenum 46, with a source of one of a plurality of differently colored developer liquids corresponding to the particular color separation to be developed. The developer liquid can be pumped from the source to plenum 46 for application to the surface of development roller 44. Alternatively, the surface development roller 44 could be placed in contact with the source of developer liquid, or with another roller delivering developer liquid, eliminating the need for a pump and plenum 46. The differently colored developer liquids may correspond, for example, to cyan, magenta, yellow, and black color separations.

In this description, the term "developer liquid" generally refers to the liquid applied to an imaging substrate such as photoreceptor 12 to develop a latent image. The developer liquid may comprise both developer particles and a carrier liquid in which the developer particles are dispersed. A suitable carrier liquid may comprise, for example, hydrocarbon solvents such as NORPAR or ISOPAR solvents commercially available from Exxon. Examples of suitable developer liquids are disclosed in copending and commonly assigned U.S. patent application Ser. No. 08/536,856 filed Sep. 29, 1995, entitled "LIQUID INK USING A GEL ORGANOSOL". The entire content of the above-referenced patent application is incorporated herein by reference.

The development roller 44 can be made, for example, from stainless steel. Each of development stations 26, 28, 30, 32 may include means for engaging development roller 44 in proximity with photoreceptor 12 to develop the appropriate latent image in an imaging region of the photoreceptor. A suitable engaging means may comprise, for example, any of a variety of camming or gear-driven mechanisms configured to move one or both of development roller 44 and photoreceptor 12 relative to one another. During engagement, development roller 44 is positioned a short distance from the surface of photoreceptor 12, forming a gap. For example, the gap may be on the order of approximately three to eight mils (0.0076 cm to 0.0203 cm). In addition, development roller 44 is moved to travel in first direction 38 by, for example, activating a motor coupled to a rotor shaft associated with the development roller. The development roller 44 supplies a thin, uniform layer of developer liquid across the gap to photoreceptor 12.

To carry out the application of developer liquid, each of development stations 26, 28, 30, 32 further includes an electrical bias means (not shown) that creates an electric field between development roller 44 and photoreceptor 12. The electric field develops the latent image previously formed by the respective exposure station 24, 25, 27, 29 with the developer liquid applied by development roller 44. The electrical bias means may comprise a charging circuit that applies to the surface of development roller 44 a charge that induces the electric field. The development roller 44 applies developer liquid to photoreceptor 12 only long enough to develop an imaging region of the photoreceptor. Upon movement of a nonimaging region of photoreceptor 12 past development roller 44, the application of developer liquid by the development roller is terminated. The application of developer liquid can be terminated by, for example, disengaging development roller 44 from proximity with photoreceptor 12, turning off the supply of developer liquid to the development roller, or obstructing the application of developer liquid from the development roller with a blade or other obstructing element. For termination of developer liquid application by disengagement, development roller 44 can be disengaged by reverse action of the same mechanism used for engagement.

A portion of the developer liquid can become back-plated on development roller 44. The back-plated developer liquid can alter the electrical properties of development roller 44, and can thereby affect uniformity of transfer of the developer liquid. To avoid nonuniformity, it may be desirable to incorporate in each of development stations 26, 28, 30, 32 a means for removing the back-plated developer liquid. A suitable means for removing the back-plated developer liquid from development roller 44 is disclosed, for example, in copending and commonly assigned U.S. patent application Ser. No. 08/538,193 filed Sep. 29, 1995, entitled "APPARATUS FOR REMOVAL OF DEVELOPER LIQUID FROM A DEVELOPMENT DEVICE." The entire content of the above-referenced patent application is incorporated herein by reference. As shown in FIG. 1, the means for removing back-plated developer liquid from development roller 44 may include a cleaning roller 47.

The movement of photoreceptor 12 takes the latent images in the imaging region past each of development stations 26, 28, 30, 32 for development with the differently colored developer liquids applied by development rollers 44. After development stations 26, 28, 30, 32 have developed each of the latent images formed by exposure stations 24, 25, 27, 29 the imaging region of the moving photoreceptor 12 encounters drying station 34. The drying station includes a heated roller 48 that forms a nip with belt roller 18. The heated roller 48 applies heat to photoreceptor 12 to dry the developer liquid applied by development stations 26, 28, 30, 32. An example of a suitable drying station is disclosed in copending and commonly assigned U.S. patent application Ser. No. 08/536,080 filed Sep. 29, 1995, entitled "DRYING METHOD AND APPARATUS FOR ELECTROPHOTOGRAPHY USING LIQUID TONERS."

The imaging region of photoreceptor 12 next arrives at transfer station 36. The transfer station 36 includes an intermediate transfer roller 50 that forms a nip with photoreceptor 12 over belt roller 14 and a heated pressure roller 52 that forms a nip with the intermediate transfer roller. The developer liquid on photoreceptor 12 transfers from the photoreceptor surface to intermediate transfer roller 50 by selective adhesion. The heated pressure roller 52 serves to transfer the image on intermediate transfer roller 52 to an output substrate 54 by application of pressure and/or heat to the output substrate. The output substrate 54 may comprise, for example, paper or film. In this manner, transfer station 36 forms a visible representation of the original multi-color image on output substrate 54. An example of a suitable transfer station is disclosed in copending and commonly assigned U.S. patent application Ser. No. 08/536,687 filed Sep. 29, 1995, entitled "METHOD AND APPARATUS HAVING IMPROVED IMAGE TRANSFER CHARACTERISTICS FOR PRODUCING AN IMAGE ON PLAIN PAPER."

The operation of imaging system 10, as described above, generally is effective in producing a visible representation of an original multi-color image. However, the quality of the image remains a constant concern. The quality of the image can be degraded, in particular, by the formation of excess developer liquid on the surface of photoreceptor 12. A first excess volume of developer liquid is produced on photoreceptor 12 during delivery of developer liquid by development roller 44 for development of the latent image. Specifically, development roller 44 applies an amount of developer liquid that exceeds the amount necessary to develop the latent image. A squeegee roller typically serves to remove this first excess volume of developer liquid from the photoreceptor 12.

A second excess volume of developer liquid is produced when delivery of developer liquid by development roller 44 is stopped. Delivery of developer liquid by development roller 44 can be stopped, for example, by disengaging the development roller from proximity with photoreceptor 12, stopping the delivery of developer liquid to the development roller, or obstructing the application of developer liquid from the development roller to the photoreceptor. In each case, a portion of the excess developer liquid remaining in the gap between photoreceptor 12 and development roller 44 tends to remain on the photoreceptor, producing a second excess volume of developer liquid on the photoreceptor. If the squeegee roller is disengaged with development roller 44, a portion of the first excess volume of developer liquid also may remain on the photoreceptor. With multiple development stations 26, 28, 30, 32, the amount of excess developer liquid can be increased, and cross contamination can occur.

In accordance with the present invention, there is provided an apparatus and method for removing from photoreceptor 12 the excess developer liquid produced by development roller 44, as well as a liquid electrographic imaging system and method incorporating an apparatus and method for removing such excess developer liquid. With further reference to FIG. 1, the apparatus and method for removing excess developer liquid from photoreceptor 12 make use of a cylindrical squeegee roller 56 arid a means for removing developer liquid from the squeegee roller. The developer liquid removing means may comprise, for example, a blade 58 as shown in FIG. 1, a vacuum, or a roller. The squeegee roller 56 and blade 58 are associated with each of development systems 26, 28, 30, 32.

The squeegee roller 56 may comprise a compliant material and preferably comprises an elastomeric material that is inert to the developer liquid used in system 10. The squeegee roller 56 may comprise, for example, a layer of urethane or nitrile mounted about a stainless steel, aluminum, or rigid plastic core. The elastomeric material may, for example, have a hardness of approximately 50 to 70 durometer Shore A. The apparatus and method further make use of a means for passively engaging squeegee roller 56 with photoreceptor 12, the squeegee roller being driven by the photoreceptor in first direction 38. The squeegee roller 56 can be loaded against photoreceptor 12, for example, by rigidly engaging the squeegee roller in contact with the photoreceptor or applying a spring bias. In either case, a thin developer liquid film typically will separate squeegee roller 56 and photoreceptor 12.

The squeegee roller 56 can be susceptible to axial deformation that can cause nonuniform pressure along the nip between the squeegee roller and the photoreceptor. To eliminate or reduce such nonuniformity, it may be desirable to incorporate a squeegee apparatus such as that disclosed, for example, in copending and commonly assigned U.S. patent application Ser. No. 08/537,128 filed Sep. 29, 1995, entitled "SQUEEGEE APPARATUS AND METHOD FOR REMOVING DEVELOPER LIQUID FROM AN IMAGING SUBSTRATE AND FABRICATION METHOD." The entire content of the above-referenced patent application is incorporated herein by reference.

During prolonged imaging sequences, squeegee roller 56 also can be susceptible to a phenomenon referred to as developer liquid "wrap-around" in which developer liquid overflows a portion of the squeegee roller and is passed downstream with photoreceptor 12. To avoid developer liquid "wrap-around," it may be desirable to further incorporate a squeegee apparatus such as that disclosed, for example, in copending and commonly assigned U.S. patent application Ser. No. 08/537,128 filed Sep. 29, 1995, entitled "APPARATUS AND METHOD FOR REMOVING EXCESS DEVELOPER LIQUID FROM AN IMAGING SUBSTRATE." The entire content of the above-referenced patent application is incorporated herein by reference. As shown in FIG. 1, this squeegee apparatus may include a second squeegee roller 57 with a blade 59 for cleaning the second squeegee roller.

During movement in first direction 38, squeegee roller 56 removes from the imaging region of photoreceptor 12 a first excess volume of developer liquid applied by the respective development station 26, 28, 30, 32. In this first mode, squeegee roller 56 serves to control the amount of developer liquid carried by photoreceptor 12, enabling the developed image to be effectively dried by drying station 34. The squeegee roller 56 forms a developer liquid film comprising only a fraction of the developer liquid initially supplied to photoreceptor 12 by development roller 44. A loading force of approximately 5 to 15 pounds (2.3 to 6.9 kilograms), for example, applied to each end of a rotor shaft supporting squeegee roller 56 has been observed to provide effective film forming of the developer liquid and removal of excess developer liquid during movement of the squeegee roller in the first direction. The imaging system 10 may include a backup roller (not shown) on a side of photoreceptor 12 opposite squeegee roller 56. The backup roller provides support for photoreceptor 12 in response to the loading of squeegee roller 56.

Upon movement of the nonimaging region of photoreceptor 12 past squeegee roller 56, the apparatus and method of the present invention operate to actively drive the squeegee roller in a second direction opposite to first direction 38. The squeegee roller 56 can be moved in the second direction by, for example, activating a motor coupled to a rotor shaft associated with the squeegee roller. By the lime the nonimaging region of photoreceptor 12 passes squeegee roller 56, the application of developer liquid from development roller 44 disposed upstream from the squeegee roller will have been terminated. Thus, the nonimaging region will carry to squeegee roller 56 a second excess volume of developer liquid remaining on photoreceptor 12 by such termination of developer liquid application. The second excess volume is sometimes referred to as a "drip line." In this second mode, the reverse movement of squeegee roller 56 substantially removes the second excess volume of developer liquid from photoreceptor 12. The loading force applied to the ends of the rotor shaft of squeegee roller 56 during passive movement in the first direction can be maintained during movement of the squeegee roller in the second direction. A loading force of approximately 1 to 3 pounds (0.45 to 1.35 kilograms) applied to each end of the rotor shaft of squeegee roller 56 has been observed to provide effective developer liquid removal during movement of the squeegee roller in the second direction. Effective developer liquid removal likely can be carried out with less loading force or more loading force applied to squeegee roller 56. However, excessive loading force may produce excessive wear on the release layer of photoreceptor 12 and may make squeegee roller 56 more difficult to drive.

Advantageously, squeegee roller 56 can be realized by adapting a squeegee roller already provided in development station 26, 28, 30, 32 for controlling the thickness of developer liquid on photoreceptor 12. A clutch and drive mechanism can be added to enable squeegee roller 56 to be driven in the second direction. Thus, the incorporation of another component for excess developer liquid removal is unnecessary. Consequently, the apparatus and method of the present invention add little cost and consume little additional space within overall imaging system 10, while significantly increasing image quality relative to existing imaging systems. If added cost and conservation of space are not critical issues, the incorporation of an additional squeegee roller in each of development stations 26, 28, 30, 32 is conceivable. The original squeegee roller 56 could be passively driven in first direction 38 by photoreceptor 12 and used for removing the first excess volume of developer liquid, whereas the additional squeegee roller could be actively driven in the second, reverse direction and used to remove the second excess volume of developer liquid. As another alternative, if recovery of developer liquid is not a concern, a single squeegee roller can be placed after the final development station 32 and used to remove the second excess volume of developer liquid produced by all of development stations 26, 28, 30, 32.

FIGS. 2–9 serve to further illustrate the problems presented by excess developer liquid on photoreceptor 12, and the operations carried out by an imaging system and method incorporating an apparatus and method for removing such excess developer liquid from a photoreceptor, in accordance with the present invention.

Figure 2:
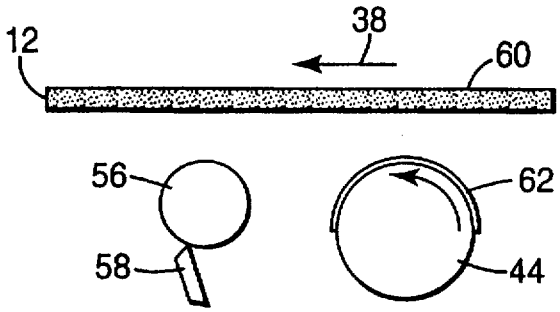
FIG. 2 is a schematic diagram illustrating a first operation carried out by an imaging system and method incorporating an apparatus and method for removing developer liquid from an imaging substrate, in accordance with the present invention.

FIG. 2 is a schematic diagram illustrating a first operation carried out by an imaging system and method incorporating an apparatus and method for removing excess developer liquid from photoreceptor 12, in accordance with the present invention. For simplicity, FIG. 2 shows photoreceptor 12 and only one of development stations 26, 28, 30, 32. As in the example of FIG. 1, the development station of FIG. 2 incorporates a development roller 44, a squeegee roller 56, and a developer liquid removing means in the form of blade 58. As shown in FIG. 2, to form an image, photoreceptor 12 is first moved in first direction 38. During the movement of a nonimaging region 60 of photoreceptor 12, development roller 44 and squeegee roller 56 may remain disengaged from proximity and contact, respectively, with the photoreceptor. During disengagement, a uniform delivery of developer liquid to development roller 44 may be established. As shown in FIG. 2, development roller 44 carries a thin, uniform layer of developer liquid 62 received from plenum 46 (not shown in FIG. 2).

Figure 3:
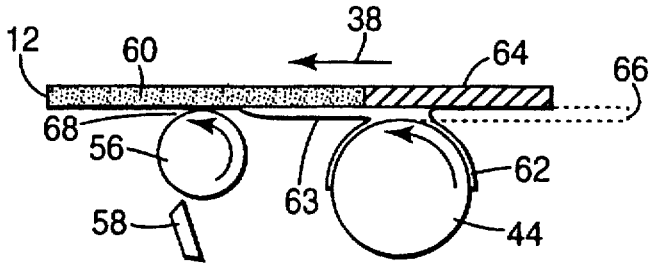
FIG. 3 is a schematic diagram illustrating a second operation carried out by an imaging system arid method incorporating an apparatus and method for removing developer liquid from an imaging substrate, in accordance with the present invention.

FIG. 3 is a schematic diagram illustrating a second operation carried out by an imaging system and method incorporating an apparatus and method for cleaning excess developer liquid from photoreceptor 12, in accordance with the present invention. As shown in FIG. 2, prior to movement past development roller 44 of an imaging region 64 of photoreceptor 12, the development roller is engaged in proximity with the photoreceptor, forming a small gap 66. The development roller 44 applies developer liquid 62 across gap 66 to imaging region 64 of photoreceptor 12. The electrical bias means associated with development roller 44 is activated to create an electric field that develops the latent image in imaging region 64 with the developer liquid applied by the development roller. As development roller 44 is engaged in proximity with imaging region 64 of photoreceptor 12, squeegee roller 56 is loaded against the photoreceptor. The loading of squeegee roller 56 against photoreceptor 12 forms a nip 68 in which a thin developer liquid film is formed. The movement of photoreceptor 12 in first direction 38 serves to drive squeegee roller 56 in the first direction by friction. The squeegee roller 56 is positioned to control the amount of developer liquid 63 remaining on photoreceptor 12 after delivery by development roller 44.

Figure 4:
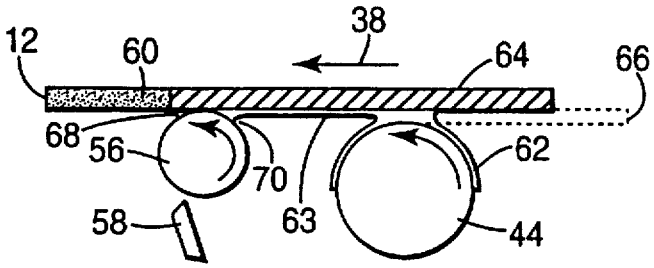
FIG. 4 is a schematic diagram further illustrating a second operation carried out by an imaging system and method incorporating an apparatus and method for removing developer liquid from an imaging substrate, in accordance with the present invention.

FIG. 4 is a schematic diagram further illustrating the second operation carried out by an imaging system and method incorporating an apparatus and method for cleaning excess developer liquid from photoreceptor 12, in accordance with the present invention. As shown in FIG. 4, imaging region 64 carries developer liquid 63 into nip 68, forming a holdup volume 70 on the upstream side of squeegee roller 56, relative to first direction 38. The squeegee roller 56 generally prevents this holdup volume from passing downstream with photoreceptor 12, thereby reducing the amount of developer liquid 63 carried by the developed latent image in imaging region 64. However, a fractional amount of film-formed developer liquid passes through squeegee roller 56 on the surface of photoreceptor 12 as the developed image. Throughout this second operation, cleaning blade 58 preferably remains disengaged from passively driven squeegee roller 56. If blade 58 were engaged with squeegee roller 56, the force of the blade could alter or stop the passive movement of the squeegee roller in response to loading against photoreceptor 12.

Figure 5:
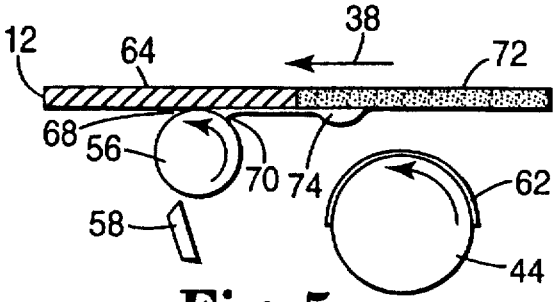
FIG. 5 is a schematic diagram illustrating a third operation carried out by an imaging system and method incorporating an apparatus and method for removing developer liquid from an imaging substrate, in accordance with the present invention.

FIG. 5 is a schematic diagram illustrating a third operation carried out by an imaging system and method incorporating an apparatus and method for cleaning excess developer liquid from a photoreceptor, in accordance with the present invention. In this third operation, upon movement past development roller 44 of a nonimaging region 72 of photoreceptor 12, application of developer liquid by the development roller is terminated by, for example, disengaging the development roller from proximity with photoreceptor 12. The disengagement of development roller 44 leaves on photoreceptor 12 a second excess volume of developer liquid 74, sometimes referred to as a "drip line." While imaging region 64 moves past squeegee roller 56, the squeegee roller continues to be passively driven by the moving photoreceptor 12, and continues to produce holdup volume 70.

Figure 6:
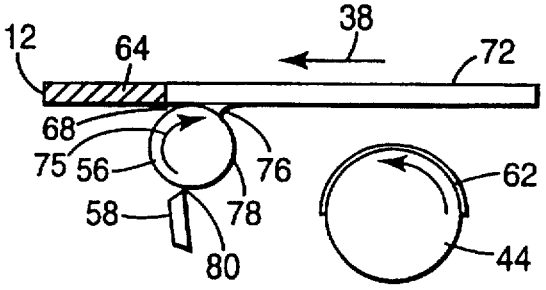
FIG. 6 is a schematic diagram illustrating a fourth operation carried out by an imaging system and method incorporating an apparatus and method for removing developer liquid from an imaging substrate, in accordance with the present invention.

FIG. 6 is a schematic diagram illustrating a fourth operation carried out by an imaging system and method incorporating an apparatus and method for cleaning excess developer liquid from photoreceptor 12, in accordance with the present invention. As shown in FIG. 6, upon movement of nonimaging region 72 of photoreceptor 12 past squeegee roller 56, the apparatus and method of the present invention operate to actively drive the squeegee roller in a second, reverse direction, indicated by arrow 75, opposite to first direction 38. The squeegee roller 56 is driven in reverse direction 75 only after imaging region 64 has passed by the squeegee roller. If squeegee roller 56 were driven in second direction 75 during passage of imaging region 64, the squeegee roller could scrape away portions of developer liquid forming the developed image, significantly degrading image quality.

The reverse driven action of squeegee roller 56 serves to substantially remove from photoreceptor 12 the second excess volume of developer liquid 74 left on the photoreceptor surface by development roller 44. The squeegee roller 56 forms a larger holdup volume 76 that contains both the first excess volume of developer liquid applied in the development process and the second excess volume of developer liquid formed upon termination of the application of developer liquid by development roller 44. The reverse-driven squeegee roller 56 prevents continued passage of holdup volume 76 downstream with photoreceptor 12. Moreover, the reverse driven action of squeegee roller 56 directs the developer liquid in holdup volume 76 downward, as indicated by reference numeral 78, on the upstream side of the squeegee roller. The rate at which the developer liquid can be removed from photoreceptor 12 is generally a function of the velocity ratio of the photoreceptor surface to the surface of squeegee roller 56, the length of the squeegee roller, and the diameter of the squeegee roller. The developer liquid removal rate also may depend on the surface characteristics of the material forming squeegee roller 56 and the fluid characteristics of the developer liquid.

As further shown in FIG. 6, the apparatus and method of the present invention also operate to engage blade 58, or an alternative developer liquid removal means, in contact with squeegee roller 58, as indicated by reference numeral 80. The reverse motion of squeegee roller 56 takes the holdup volume 76 of developer liquid away from nip 68 and transports the developer liquid downward. The blade 58 removes from squeegee roller 56 the developer liquid removed from photoreceptor 12 by the squeegee roller, and diverts the developer liquid to drain into developer liquid recovery reservoir 42 (not shown in FIG. 6). The blade 58 provides squeegee roller 56 with a clean surface for removal of additional developer liquid from photoreceptor 12 in the next revolution of the squeegee roller. Thus, blade 58 greatly enhances the ability of squeegee roller 56 to remove excess developer liquid from photoreceptor 12. The blade 58 should maintain uniform contact pressure across the entire lateral width of the cylindrical squeegee roller 56. Thus, blade 58 preferably is made of a material selected so as to avoid warping or swelling. An example of a suitable material for formation of cleaning blade 58 is Fluoroelastomer FC 2174, available from Minn. Mining & Manufacturing Company (3M) of St. Paul, Minnesota.

As an example, if a squeegee roller 56 having an outer Nitrile layer of approximately 50 to 70 durometer Shore A, a diameter of approximately 1.54 centimeters, and a length of approximately 23 centimeters, is driven in the second direction at approximately 20.32 centimeters per second, and loaded against a photoreceptor 12 moving in the first direction at approximately 10.16 centimeters per second with a loading force of approximately 0.45 to 1.35 kilograms applied at each end of the squeegee roller rotor shaft, excess developer liquid removal rate on the order of 1.6 cubic centimeters per Application be expected. Application of blade 58 to remove developer liquid from squeegee roller 56 is important for maintenance of the removal rate over time. An increase in the surface speed of squeegee roller 56 can further increase the developer liquid removal rate.

Figure 7:
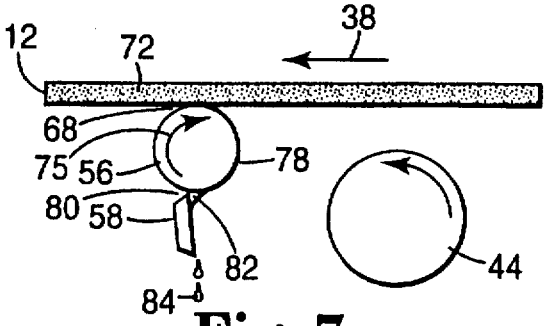
FIG. 7 is a schematic diagram further illustrating a fourth operation carried out by an imaging system and method incorporating an apparatus and method for removing developer liquid from an imaging substrate, in accordance with the present invention.

FIG. 7 is a schematic diagram further illustrating the fourth operation carried out by an imaging system and method incorporating an apparatus and method for cleaning excess developer liquid from photoreceptor 12, in accordance with the present invention. In particular, FIG. 7 further illustrates the cleaning action of cleaning blade 58. As squeegee roller 56 continues to move in second direction 75, cleaning excess developer liquid from nonimaging region 72 of photoreceptor 12, blade 58 removes developer liquid from the squeegee roller, as indicated by reference numeral 82. The blade 58 directs the developer liquid scraped from squeegee roller 56 downward, as indicated by reference numeral 84, for collection by reservoir 42 associated with the particular development station. The developer liquid recovered by reservoir 42 (not shown in FIG. 7) can be recycled, thereby reducing developer liquid consumption in the overall system.

Figure 8:
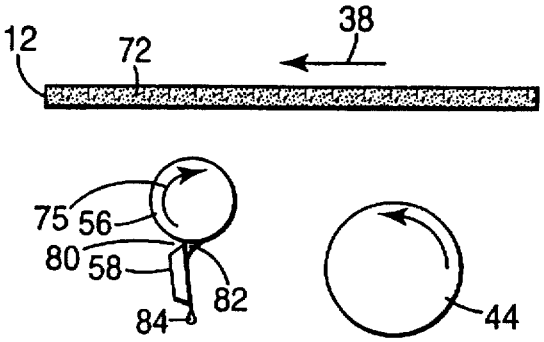
FIG. 8 is a schematic diagram illustrating a fifth operation carried out by an imaging system and method incorporating an apparatus and method for removing developer liquid from an imaging substrate, in accordance with the present invention.

FIG. 8 is a schematic diagram illustrating a fifth operation carried out by an imaging system and method incorporating an apparatus and method for cleaning excess developer liquid from photoreceptor 12, in accordance with the present invention. In particular, FIG. 8 shows the disengagement of squeegee roller 56 from contact with photoreceptor 12 after removal of the first and second excess volumes of developer liquid, and the continued engagement of blade 58 in contact with the squeegee roller after disengagement. In this operation, squeegee roller 56 continues to be driven in second direction 75 while blade 58 removes any remaining developer liquid for recovery by reservoir 42 (not shown), as indicated by reference numerals 82 and 84.

Figure 9:
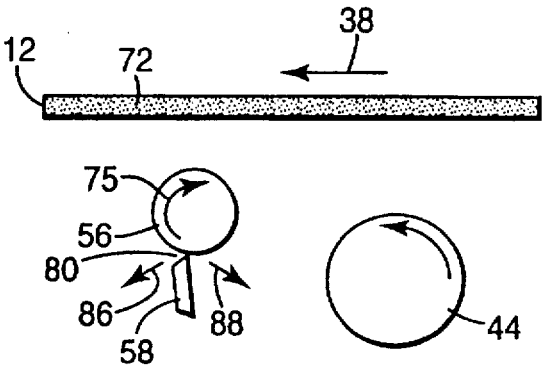
FIG. 9 is a schematic diagram illustrating a sixth operation carried out by an imaging system and method incorporating an apparatus and method for removing developer liquid from an imaging substrate, in accordance with the present invention.

FIG. 9 is a schematic diagram illustrating a sixth operation carried out by an imaging system and method incorporating an apparatus and method for cleaning excess developer liquid from a photoreceptor, in accordance with the present invention. Upon disengagement, squeegee roller 56 has eliminated the first and second excess volumes of developer liquid from photoreceptor 12. However, a small amount of developer liquid may cling to squeegee roller 56 by surface tension at the squeegee roller/cleaning blade nip 80. As shown in FIG. 9, this operation involves the steps of disengaging blade 58 from contact with squeegee roller 56 and reengaging the blade in contact with the squeegee roller a plurality of times. For example, the edge of blade 58 can be pulsed on and off of squeegee roller 56 a number of times, as indicated by reference numerals 86, 88 to remove an additional amount of developer liquid at each revolution of the squeegee roller. At the end of the complete process, squeegee roller 56 is clean and ready for the next imaging sequence.

In a multi-color imaging system, the apparatus and method for removing excess developer liquid from photoreceptor 12, as described above, preferably is applied at each of development stations 26, 28, 30, 32 to eliminate each differently colored volume of excess developer liquid. Alternatively, the apparatus and method could be applied at a single location to remove developer liquid applied by each of development stations 26, 28, 30, 32. The apparatus and method overcome the problems that can occur in existing imaging systems due to excess developer liquid. Specifically, the apparatus and method of the present invention prevent significant cross contamination of differently colored developer liquids due to formation of excess developer liquid. Further, the apparatus and method avoid the accumulation of excessive developer liquid volumes on the photoreceptor that can contaminate the image being formed. The problems of incomplete image transfer from the photoreceptor and image staining are thereby mitigated. In addition, the apparatus and method prevent the contamination of internal components of the imaging system, and thereby reduce the frequency of vigorous cleaning cycles. The apparatus and method also enable excess developer liquid to be reused, increasing the number of images that can be formed for a given volume of developer liquid.

Having described the exemplary embodiments of the apparatus and method of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A method for removing developer liquid from an imaging substrate, the method comprising the steps of:

moving the imaging substrate in a first direction;

loading a squeegee roller against the imaging substrate, the squeegee roller being driven by the imaging substrate in the first direction, wherein the squeegee roller removes from an imaging region of the imaging substrate a first excess volume of developer liquid applied by a development device during development of a latent electrostatic image in the imaging region of the imaging substrate; and driving the squeegee roller in a second direction opposite to the first direction upon movement of a nonimaging region of the imaging substrate past the squeegee roller, the squeegee roller substantially removing from the imaging substrate a second excess volume of developer liquid formed by termination of application of developer liquid to the imaging substrate by the development device.

2. The method of claim 1, further comprising the step of removing from the squeegee roller at least a portion of the developer liquid removed from the imaging substrate by the squeegee roller during movement of the squeegee roller in the second direction.

3. The method of claim 2, further comprising the steps of unloading the squeegee roller from the imaging substrate, and continuing the step of removing from the squeegee roller at least a portion of the developer liquid removed from the imaging substrate.

4. The method of claim 3, wherein the step of removing from the squeegee roller at least a portion of the developer liquid removed from the imaging substrate includes engaging a blade in contact with the squeegee roller, the blade removing from the squeegee roller at least a portion of the developer liquid removed from the imaging substrate.

5. The method of claim 4, further comprising the steps of disengaging the blade from contact with the squeegee roller and reengaging the blade in contact with the squeegee roller a plurality of times.

6. The method of claim 1, wherein the development device comprises a development roller, and termination of application of developer liquid to the imaging substrate by the development device occurs upon disengagement of the development roller from proximity with the imaging substrate.

7. The method of claim 1, wherein the imaging substrate is a photoreceptor in a liquid electrophotographic imaging system.

8. An apparatus for removing excess developer liquid from an imaging substrate, the apparatus comprising:

means for moving the imaging substrate in a first direction;

a squeegee roller;

means for loading the squeegee roller against the imaging substrate, the squeegee roller being driven by the imaging substrate in the first direction, wherein the squeegee roller removes from an imaging region of the imaging substrate a first excess volume of developer liquid applied by a development device during development of a latent electrostatic image in the imaging region of the imaging substrate; and means for driving the squeegee roller in a second direction opposite to the first direction upon movement of a nonimaging region of the imaging substrate past the squeegee roller, the squeegee roller substantially removing from the imaging substrate a second excess volume of developer liquid formed by termination of application of developer liquid to the imaging substrate by the development device.

9. The apparatus of claim 8, further comprising means for removing from the squeegee roller at least a portion of the developer liquid removed from the imaging substrate by the squeegee roller during movement of the squeegee roller in the second direction.

10. The apparatus of claim 9, further comprising means for unloading the squeegee roller from the imaging substrate, and means for continuing operation of the means for removing from the squeegee roller at least a portion of the developer liquid removed from the imaging substrate.

11. The apparatus of claim 10, wherein the means for removing from the squeegee roller at least a portion of the developer liquid removed from the imaging substrate includes a blade, and means for engaging the blade in contact with the squeegee roller, the blade removing from the squeegee roller at least a portion of the developer liquid removed from the imaging substrate.

12. The apparatus of claim 11, further comprising means for disengaging the blade from contact with the squeegee roller and reengaging the blade in contact with the squeegee roller a plurality of times.

13. The apparatus of claim 8, wherein the development device comprises a development roller, and termination of application of developer liquid to the imaging substrate by the development device occurs upon disengagement of the development roller from proximity with the imaging substrate.

14. The apparatus of claim 8, wherein the imaging substrate is a photoreceptor in a liquid electrophotographic imaging system.

15. A method for removing developer liquid from an imaging substrate, the method comprising the steps of:

moving the imaging substrate in a first direction;

positioning a squeegee roller such that the squeegee roller is driven by the imaging substrate in the first direction, wherein the squeegee roller removes from an imaging region of the imaging substrate a first excess volume of developer liquid; and driving the squeegee roller in a second direction opposite to the first direction upon movement of a nonimaging region of the imaging substrate past the squeegee roller to remove from the imaging substrate a second excess volume of developer liquid.

16. An apparatus for removing developer liquid from an imaging substrate, the apparatus comprising:

a squeegee roller positioned such that the squeegee roller is driven by the imaging substrate in a first direction, wherein the squeegee roller removes from an imaging region of the imaging substrate a first excess volume of developer liquid; and a mechanism that drives the squeegee roller in a second direction opposite to the first direction upon movement of a nonimaging region of the imaging substrate past the squeegee roller to remove from the imaging substrate a second excess volume of developer liquid.

* * * * *